US005931504A

United States Patent [19]

Armitage

[11] Patent Number: 5,931,504

[45] Date of Patent: Aug. 3, 1999

[54] WIND SKI

[76] Inventor: Arthur C. Armitage, 4329 Cliffside Dr. NE., Tacoma, Wash. 98422

[21] Appl. No.: 08/813,882

[22] Filed: Mar. 6, 1997

[51] Int. Cl.[6] ..... A63C 11/00

[52] U.S. Cl. ..... 280/810; 280/14.2

[58] Field of Search ..... 280/809, 810, 280/818, 14.2, 15, 16, 28.14, 28.15, 28.16, 17; 483/378, 381; 441/70, 74

[56] References Cited

U.S. PATENT DOCUMENTS

| | | | |
|---|---|---|---|
| 1,663,060 | 3/1928 | Rainey | 280/16 |
| 2,318,147 | 5/1943 | Ericson | 280/14.2 |
| 3,190,668 | 6/1965 | Husak | 280/28.14 |
| 3,297,334 | 1/1967 | Jenks | 280/28.14 |
| 3,695,626 | 10/1972 | Alexander, Jr. | 280/28.14 |
| 3,744,811 | 7/1973 | Johnston | 280/28.14 |
| 3,870,329 | 3/1975 | Evequoz | 280/16 |
| 3,982,766 | 9/1976 | Budge | 280/810 |
| 4,204,694 | 5/1980 | Freeman | 280/810 |
| 4,533,159 | 8/1985 | Seidel | 280/810 |
| 4,601,488 | 7/1986 | Jarrett | 280/810 |
| 4,708,353 | 11/1987 | Evequoz | 280/14.2 |
| 5,277,141 | 1/1994 | Csepregi | 280/810 |
| 5,609,351 | 3/1997 | Vermillion | 280/14.2 |

FOREIGN PATENT DOCUMENTS

| | | | |
|---|---|---|---|
| 2428452 | 1/1980 | France | 280/14.2 |
| 2574741 | 6/1986 | France | 280/14.2 |
| 2938877 | 4/1981 | Germany | 280/810 |
| 4101550 | 7/1992 | Germany | 280/14.2 |
| 2094238 | 9/1982 | United Kingdom | 280/810 |

*Primary Examiner*—J J Swann
*Assistant Examiner*—Frank Vanaman
*Attorney, Agent, or Firm*—Patent & Trademark Services; Joseph H. McGlynn

[57] ABSTRACT

An improved wind-propelled ski apparatus which comprises a ski, risers and deck. The risers comprise upper and lower platforms and connecting positioned members between the platforms. The risers are attached to the ski and provide an elevated surface for the installation of a deck, where the rider's feet are positioned. The elevation of the rider's feet provides greater control of the ski and protection for the rider's feet. The ski is an elongated, planar member having a series of openings along its length for the attachment of a sail mount and the risers. The openings can accommodate the risers and the sail mount in various positions on the ski to adapt to the needs of the rider.

2 Claims, 1 Drawing Sheet

WIND SKI

BACKGROUND OF THE INVENTION

The present invention relates generally to wind-propelled recreational equipment, and particularly to an improved wind-propelled, hard-water sailing craft, comprising risers for the installation of an elevated deck, and means for positioning the deck and sail mount at various points along the craft.

DESCRIPTION OF THE PRIOR ART

One of the earliest records of a land sailing craft is that of Kaotahang Wu-Su, who in the 6th century is recorded as having successfully built a wind-propelled carriage capable of carrying some thirty men.

In the 17th century the Dutch mathematician, Simeon Stevin, constructed a sailing carriage that traversed in two hours a distance it took fourteen hours to walk.

Sailing on skates is depicted in the "Illustrated London News" of Jan. 31, 1880.

In 1970 the concept of sailing with a minimum of boat, sail, and rig was introduced into the world in the form of the wind surfer, U.S. Pat. No. 3,487,800.

A recent trend in skiing and skating is to use wind-propelled vehicles, an activity which closely resembles the popular water sport of "wind surfing".

Several wind-propelled recreational vehicles have been developed for use outside of the wind surfing environment. For example, U.S. Pat. No. 4,601,488 describes a sailing ski for use on snow and ice, comprising a ski, a universal mast mount, and foot straps.

U.S. Pat. No. 4,533,159 discloses a wind propulsion apparatus for skiers and skaters, comprising a sail secured to a mast and guide pulleys mounted on the user's boots.

U.S. Pat. No. 4,204,694 describes a sail structure for use in propelling a ski, skate, or and ice boat.

U.S. Pat. No. 3,982,766 discloses a wind-propelled skateboard.

All of the above inventions, however, are deficient in terms of the degree of control the user has over the vehicle. Wind can be a very powerful form of propulsion, and users of the above vehicles must exert a great deal of force and effort in negotiating turns or other maneuvers.

The above inventions are lacking in that they do not allow the positioning of the rider's body to oppose these forces, nor do they allow for the adjustment of the opposition of the sail. The prior art apparatus do not allow the rider's feet to take a natural position or stance opposing the forces of the sail, nor do they prevent the rider's feet from becoming embedded in snow and ice. As a result of these limitations, the vehicles are not suitable for riders of varying size and strengths. Thus, there remains a need for a wind ski which affords a greater degree of navigational control. There also remains a need for a wind ski which has a means to adjust the location of the sail and of the rider's feet, and one which protects the user's feet from snow, ice, and hidden obstacles.

SUMMARY OF THE INVENTION

The present invention is an improved wind-propelled, snow sailing craft: a wind ski. The invention comprises a ski, risers and deck. The risers are affixed to the upper surface of the ski and provide an elevated surface for the installation of a deck. The deck provides a surface on which the rider stands. The elevation of the rider's feet above the ski provides greater maneuverability and directional control of the vehicle. It also allows for the placement of the rider's feet in a position providing greater leverage with which to "edge" the ski. The elevation also protects the rider's feet from snow, ice, and hidden obstacles.

Accordingly, it is an object of the present invention to provide an improved snow sailing craft, a wind ski.

It is a further object of this invention to provide a ski in the form of an elongated planar member having a series of openings along its length for the attachment of a sail mount and risers. The openings can accommodate the risers and the sail mount in various positions on the ski to adapt to the individual rider. The risers can be placed at different locations on the ski configuration to suit the sail, wind speed or terrain.

It is a further object of the present invention to provide an improved wind ski apparatus which elevates the feet of the rider above the surface of the snow.

It is a further object of the present invention to provide an improved wind ski apparatus which provides for adjustment of the position of the rider's feet and of the sail mount.

These and other objects and advantages of the present invention will become readily apparent from the detailed description below, when taken in conjunction with the annexed drawings.

DESCRIPTION OF THE PREFERRED EMBODIMENT

Figure 1:
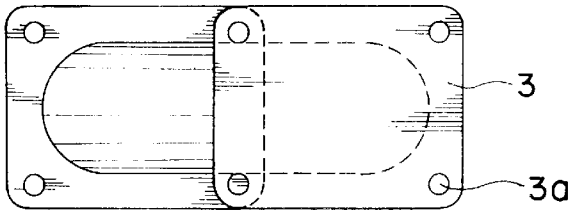
FIG. 1 shows a top plan view of the riser of the present invention.
Figure 2:
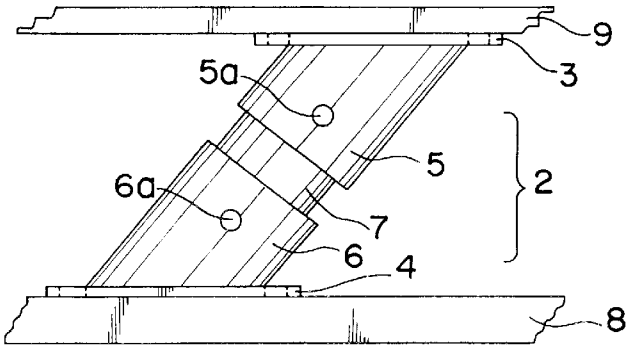
FIG. 2 shows a side view of a riser of the present invention.

Referring now to the drawings in greater detail, it can be seen in FIGS. 1 and 2 that the present invention 1 comprises a riser 2 having an upper platform 3, a lower platform 4, and connecting members 5, 6, 7 positioned between the platforms 3 and 4.

As shown in FIG. 1, the upper platform 3 is provided with openings 3*a* for attachment by screws or other suitable means to a deck 9. The deck 9 will consist of a planar surface of sufficient width to accommodate the feet of the rider. It will have a "non-skid" or other suitable surface 9*a* for the user's feet to provide traction in opposition to the forces of the wind in the sail. Additionally increased control is provided by the use of footstraps 9*b*, to assist in retaining the position of the rider's feet on the deck 9.

Figure 4:
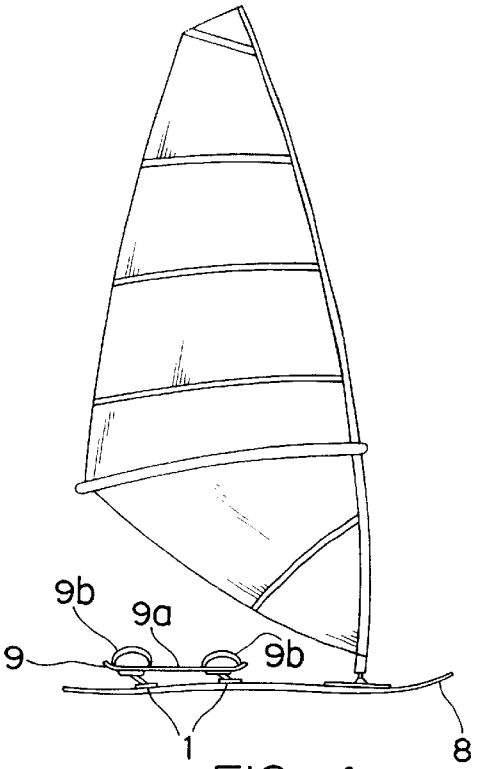
FIG. 4 shows a side view of the present invention.
Figure 3:
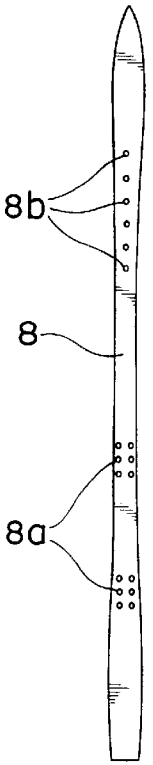
FIG. 3 shows a top plan view of the ski of the present invention.

The lower platform 4 is provided with similar openings for the attachment to the riser mounting holes 8*a* on the ski 8, shown in FIG. 3.

The connecting members 5, 6, and 7 are hollow, generally cylindrical pieces constructed from aluminum, PVC, or any other lightweight, durable material. Upper and lower connecting members 5 and 6 are bolted, welded, or otherwise securely fastened to the upper and lower platforms 3 and 4, respectively.

In an alternative embodiment, the upper and lower connecting members 5 and 6 may be molded as a unitary part of the upper and lower platforms 3 and 4. As shown in FIG. 2, the middle connecting member 7 is a solid tubular member and is telescopically received into the upper connecting member 5 and 6 and into the lower connecting member 6. When the lower platform 4 of the riser 2 is attached to the ski 8, the connecting members 5, 6 and 7 elevate the upper platform 3 above the upper surface of the ski 8. Retaining bolts or pins 5*a* and 6*a* project transversely through the connecting members 5, 6 and 7 to hold the members together. The retaining pins or bolts 5*a* and 6*a* may be removed to quickly transfer the riser 2 to different skis.

As shown in FIG. 3, the ski 8 is a planar, elongated member resembling a conventional snow ski except as described herein. The ski 8 is provided with a series of paired riser mounting holes 8*a*. The riser mounting holes 8*a* correspond with the openings on the lower platform 4 of the riser 2, providing for the positioning of the risers 2 at various points along the ski 8. The rider can thus position the risers 2 to achieved the desired center of resistance.

Also provided on the ski 8 is a series of sail mount openings 8*b* for the installation of a conventional universal sail mount. The sail mount openings 8*b* are disposed at various distances from the front portion of the ski 8. The sail mount thus may be placed at different distances from the risers 2 to suit the individual rider. The sail mount openings 8*b* and the riser mount holes 8*a* are preferably threaded so that the risers 2 and the sail mount (not shown) may be screwed or bolted to the ski 8.

The elevation of the rider's feet afforded by the risers 2 and deck 9 gives a greater degree of control over the ski 8. The elevation of the deck 9 allows the deck 9 to be of sufficient width as to allow the rider's feet to be placed in a more natural position, traverse the longitudinal axes of the ski, opposed to the force of the wind in the sail. This position allows the rider a natural "see-saw" or heel-toe movement of the feet to achieve the "edging" of the ski to make turns and other maneuvers. The rider's feet are also protected from snow, ice, and obstacles.

Although the wind ski and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A wind propelled apparatus, comprising:

a first platform adapted to transport a user over a solid surface, said first platform having a bottom surface for contacting said solid surface, and a top surface, a second platform adapted for a user to stand on, said second platform having a top surface and a bottom surface, and wherein said top surface of said first platform has means for mounting a sail in a plurality of positions, said means for mounting a sail in a plurality of positions being positioned adjacent a front of said apparatus, means attached to said top surface of said first platform and to said bottom surface of said second platform for elevating said second platform above said first platform, said means for elevating said second platform above said first platform comprising a pair of elements, each of which is attached to said top surface of said first platform, and to said bottom surface of said second platform, and each of said elements having a front side and a back side, said front side of each of said elements is closer to said front of said apparatus than said back side of each of said elements, each of said elements being attached to said first platform at an angle, with said back side of each of said elements making an acute angle with said first platform.

2. The wind propelled apparatus as claimed in claim 1, wherein said first platform has a plurality of mounting means for mounting said first and second elements in different positions with respect to said front of said apparatus.

* * * * *